US007317806B2

(12) United States Patent
Harvey et al.

(10) Patent No.: US 7,317,806 B2
(45) Date of Patent: Jan. 8, 2008

(54) SOUND TUBE TUNED MULTI-DRIVER EARPIECE

(75) Inventors: Jerry J. Harvey, Newport Beach, CA (US); Medford Alan Dyer, San Diego, CA (US)

(73) Assignee: Ultimate Ears, LLC, Irvine, CA (US)

( * ) Notice: Subject to any disclaimer, the term of this patent is extended or adjusted under 35 U.S.C. 154(b) by 164 days.

(21) Appl. No.: 11/333,151

(22) Filed: Jan. 17, 2006

(65) Prior Publication Data

US 2006/0133636 A1 Jun. 22, 2006

Related U.S. Application Data

(63) Continuation-in-part of application No. 11/051,865, filed on Feb. 4, 2005, which is a continuation-in-part of application No. 11/034,144, filed on Jan. 12, 2005, now Pat. No. 7,194,103.

(60) Provisional application No. 60/639,407, filed on Dec. 22, 2004, provisional application No. 60/639,173, filed on Dec. 22, 2004.

(51) Int. Cl.
*H04R 25/00* (2006.01)

(52) U.S. Cl. ..... 381/328; 381/322

(58) Field of Classification Search ..... 381/23.1, 381/71.6, 71.7, 74, 151, 312, 317, 322, 328, 381/370, 372, 380, 381; 455/575.2; 379/428.01; 181/129, 130, 135

See application file for complete search history.

(56) References Cited

U.S. PATENT DOCUMENTS 4,548,082 A * 10/1985 Engebretson et al. ..... 381/328
4,629,833 A * 12/1986 Kern et al. ..... 381/320
4,677,679 A 6/1987 Killion
4,763,753 A 8/1988 Killion
5,692,059 A * 11/1997 Kruger ..... 381/151
5,887,070 A 3/1999 Iseberg et al.
2006/0045297 A1* 3/2006 Haussmann ..... 381/322

FOREIGN PATENT DOCUMENTS

JP 05022797 A * 1/1993

* cited by examiner

*Primary Examiner*—Brian Ensey
(74) *Attorney, Agent, or Firm*—Patent Law Office of David G. Beck

(57) ABSTRACT

A method of optimizing the audio performance of an earpiece and the resultant device are provided. The disclosed earpiece combines at least two drivers within a single earpiece. If a pair of drivers is used, each driver has a discrete sound delivery tube. If more than two drivers are used, preferably the outputs from the two lower frequency drivers are merged into a single sound delivery tube while the output from the third driver is maintained in a separate, discrete sound tube. To compensate for the inherent phase shift of the earpiece the lengths of the sound delivery tubes, and thus driver offset, are regulated. Further audio performance optimization can be achieved through an iterative process of measuring the performance of the earpiece and making further, minor adjustments to the sound delivery tube lengths. The sound delivery tubes can include transition regions. The earpiece is configured to use removable/replaceable eartips. Acoustic filters can be interposed between one or both driver outputs and the earpiece output.

28 Claims, 10 Drawing Sheets

SOUND TUBE TUNED MULTI-DRIVER EARPIECE

CROSS-REFERENCES TO RELATED APPLICATIONS

This application is a continuation-in-part of U.S. patent application Ser. No. 11/051,865, filed Feb. 4, 2005, which is a continuation-in-part of U.S. patent application Ser. No. 11/034,144, filed Jan. 12, 2005 now U.S. Pat. No. 7,194,103, which claims the benefit of U.S. Provisional Patent Application Ser. Nos. 60/639,407, filed Dec. 22, 2004, and 60/639,173, filed Dec. 22, 2004, all the disclosures of which are incorporated herein by reference for any and all purposes.

FIELD OF THE INVENTION

The present invention relates generally to audio monitors and, more particularly, to an in-ear multi-driver earpiece.

BACKGROUND OF THE INVENTION

Earpieces, also referred to as in-ear monitors and canal phones, are commonly used to listen to both recorded and live music. A typical recorded music application would involve plugging the earpiece into a music player such as a CD player, flash or hard drive based MP3 player, home stereo, or similar device using the earpiece's headphone jack. Alternately, the earpiece can be wirelessly coupled to the music player. In a typical live music application, an on-stage musician wears the earpiece in order to hear his or her own music during a performance. In this case, the earpiece is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, increased mobility for the musician and the reduction of ambient sounds.

Earpieces are quite small and are normally worn just outside the ear canal. As a result, the acoustic design of the earpiece must lend itself to a very compact design utilizing miniature components. Some monitors are custom fit (i.e., custom molded) while others use a generic "one-size-fits-all" earpiece.

Prior art earpieces use either one or more diaphragm-based drivers, one or more armature-based drivers, or a combination of both driver types. Broadly characterized, a diaphragm is a moving-coil speaker with a paper or mylar diaphragm. Since the cost to manufacture diaphragms is relatively low, they are widely used in many common audio products (e.g., ear buds). In contrast to the diaphragm approach, an armature receiver utilizes a piston design. Due to the inherent cost of armature receivers, however, they are typically only found in hearing aids and high-end in-ear monitors.

Armature drivers, also referred to as balanced armatures, were originally developed by the hearing aid industry. This type of driver uses a magnetically balanced shaft or armature within a small, typically rectangular, enclosure. A single armature is capable of accurately reproducing low-frequency audio or high-frequency audio, but incapable of providing high-fidelity performance across all frequencies. To overcome this limitation, armature-based earpieces often use two, or even three, armature drivers. In such multiple armature arrangements, a crossover network is used to divide the frequency spectrum into multiple regions, i.e., low and high or low, medium, and high. Separate armature drivers are then used for each region, individual armature drivers being optimized for each region. In contrast to the multi-driver approach often used with armature drivers, earpieces utilizing diaphragm drivers are typically limited to a single diaphragm due to the size of the diaphragm assembly. Unfortunately, as diaphragm-based monitors have significant frequency roll off above 4 kHz, an earpiece with a single diaphragm cannot achieve the desired upper frequency response while still providing an accurate low frequency response.

In order to obtain the best possible performance from an earpiece, the driver or drivers within the earpiece are tuned. Armature tuning is typically accomplished through the use of acoustic filters (i.e., dampers). Further armature tuning can be achieved by porting, or venting, the armature enclosure as well as the earpiece itself. Diaphragm drivers, due to the use of a moving-coil speaker, are typically tuned by controlling the dimensions of the diaphragm housing. Depending upon the desired frequency response, the diaphragm housing may or may not be ported.

SUMMARY OF THE INVENTION

The present invention provides a method of optimizing the audio performance of an earpiece and the resultant device. The disclosed earpiece combines at least two drivers (e.g., two armature drivers, an armature driver and a diaphragm driver, etc.) within a single earpiece, thereby taking advantage of the capabilities of each driver. If a pair of drivers is used, each driver has a discrete sound delivery tube. If more than two drivers are used, preferably the outputs from the two lower frequency drivers are merged into a single sound delivery tube while the output from the third driver is maintained in a separate, discrete sound tube. The sound delivery tubes remain separate throughout the entire earpiece. To compensate for the inherent phase shift of the earpiece the lengths of the sound delivery tubes, and thus driver offset, are regulated. Further audio performance optimization can be achieved through an iterative process of measuring the performance of the earpiece and making further, minor adjustments to the sound delivery tube lengths.

The end portion of the earpiece is configured to use a variety of removable/replaceable eartips (e.g., foam sleeves, flanged sleeves, etc.), thus allowing the earpiece to be easily tailored to comfortably fit within any of a variety of ear canals. The sound delivery tubes can be of uniform diameter or transition from one inside diameter to another inside diameter. The larger diameter can be located at either the input region or the output region of the sound delivery tubes. In at least one embodiment, acoustic filters (i.e., dampers) are interposed between one or both driver acoustic outputs and the earpiece output.

A further understanding of the nature and advantages of the present invention may be realized by reference to the remaining portions of the specification and the drawings.

DESCRIPTION OF THE SPECIFIC EMBODIMENTS

Figure 1:
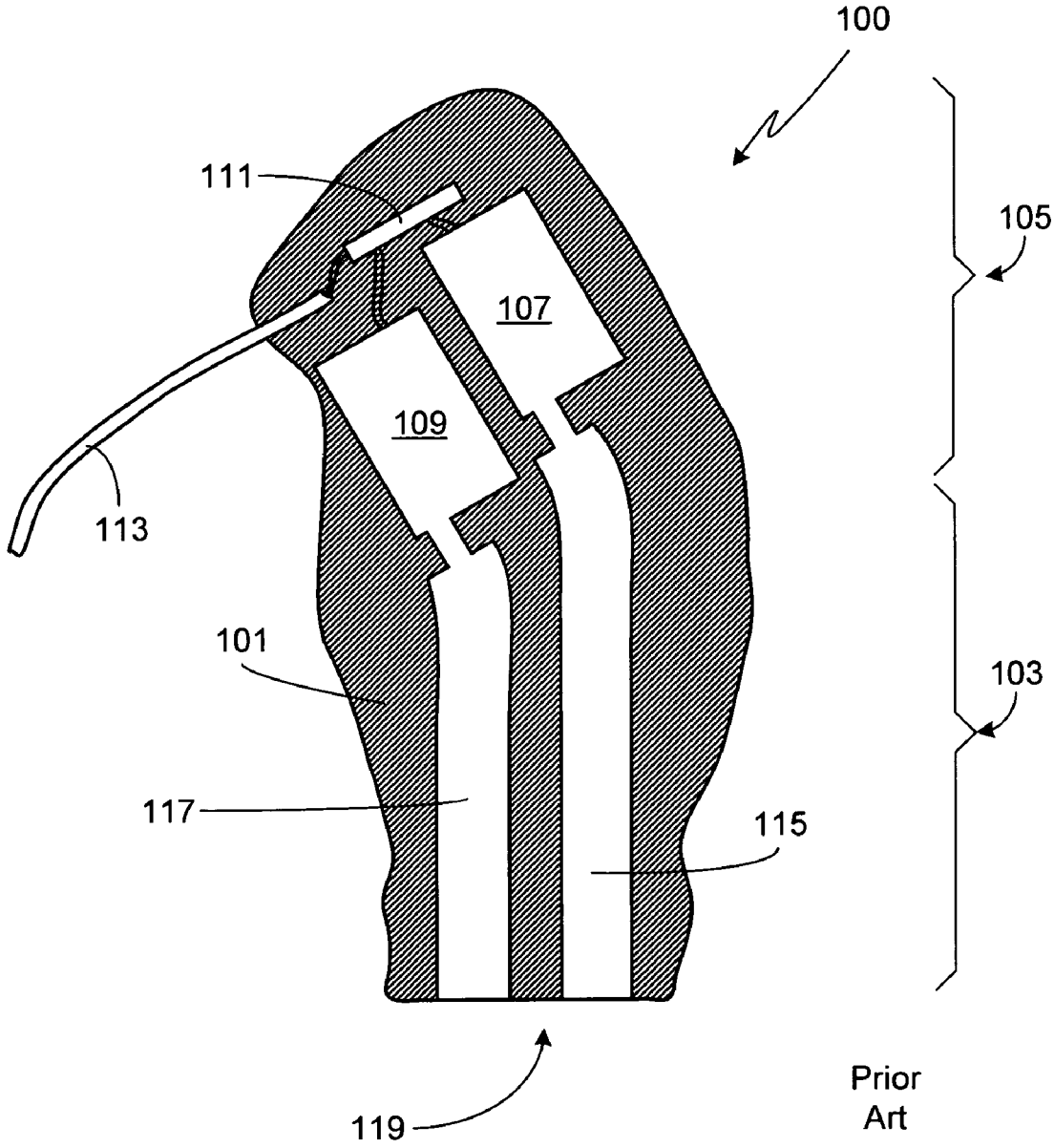
FIG. 1 is a cross-sectional view of a custom fit earpiece according to the prior art.

FIG. 1 is a cross-sectional view of a custom fit earpiece 100 according to the prior art. The term "custom fit" refers to the well known practice in both the in-ear monitor and hearing aid industries of fitting an earpiece to a particular user's ears and, more specifically, to one of the ears of a particular user. In order to custom fit an earpiece, a casting is taken of the user's ear canal and concha. Then an earpiece of the desired type is molded from the casting.

As shown in FIG. 1, earpiece 100 includes a molded earpiece housing 101, a first section 103 of which is designed to fit within the outer ear canal of the user and a second section 105 of which is designed to fit within the concha portion of the ear. In the illustrated example, earpiece 100 includes a low-frequency driver armature driver 107 and a high-frequency armature driver 109. A circuit 111, such as a passive crossover circuit or an active crossover circuit, provides input to armature drivers 107 and 109. Crossover circuit 111 is coupled to the external sound source (not shown) via a cable 113. The external sound source may be selected from any of a variety of sources such as an audio receiver, mixer, music player, headphone amplifier or other source type. As is well known in the industry, earpiece 100 can also be wirelessly coupled to the desired source.

Since custom fit earpieces are molded to fit the exact shape of the user's ear, and because the ear canal section 103 of the earpiece is molded around the delivery tube or tubes, this type of earpiece is large enough to accommodate a pair of delivery tubes 115/117 as shown. Typical dimensions for sound delivery tubes, such as tubes 115 and 117, are an inside diameter (ID) of 1.9 millimeters and an outside diameter (OD) of 2.95 millimeters. Given that the end tip (i.e., surface 119) of a custom fit earpiece is approximately 9 millimeters by 11 millimeters, it is clear that such earpieces are sufficiently large for dual sound tubes.

Although custom fit earpieces typically allow the use of a pair of delivery tubes as shown in FIG. 1, the molding process combined with the shape of the user's ear will typically dictate the locations of the earpiece components (e.g., drivers). Thus while the custom molding process will yield a better fitting earpiece, it will limit design flexibility (e.g., component location).

Generic earpieces offer an alternative approach to in-ear monitor design. This type of earpiece is generally much less expensive as custom molds are not required and the earpieces can be manufactured in volume. In addition to the cost factor, generic earpieces are typically more readily accepted by the general population since many people find it both too time consuming and somewhat unnerving to have to go to a specialist, such as an audiologist, to be fitted for a custom earpiece.

Figure 2:
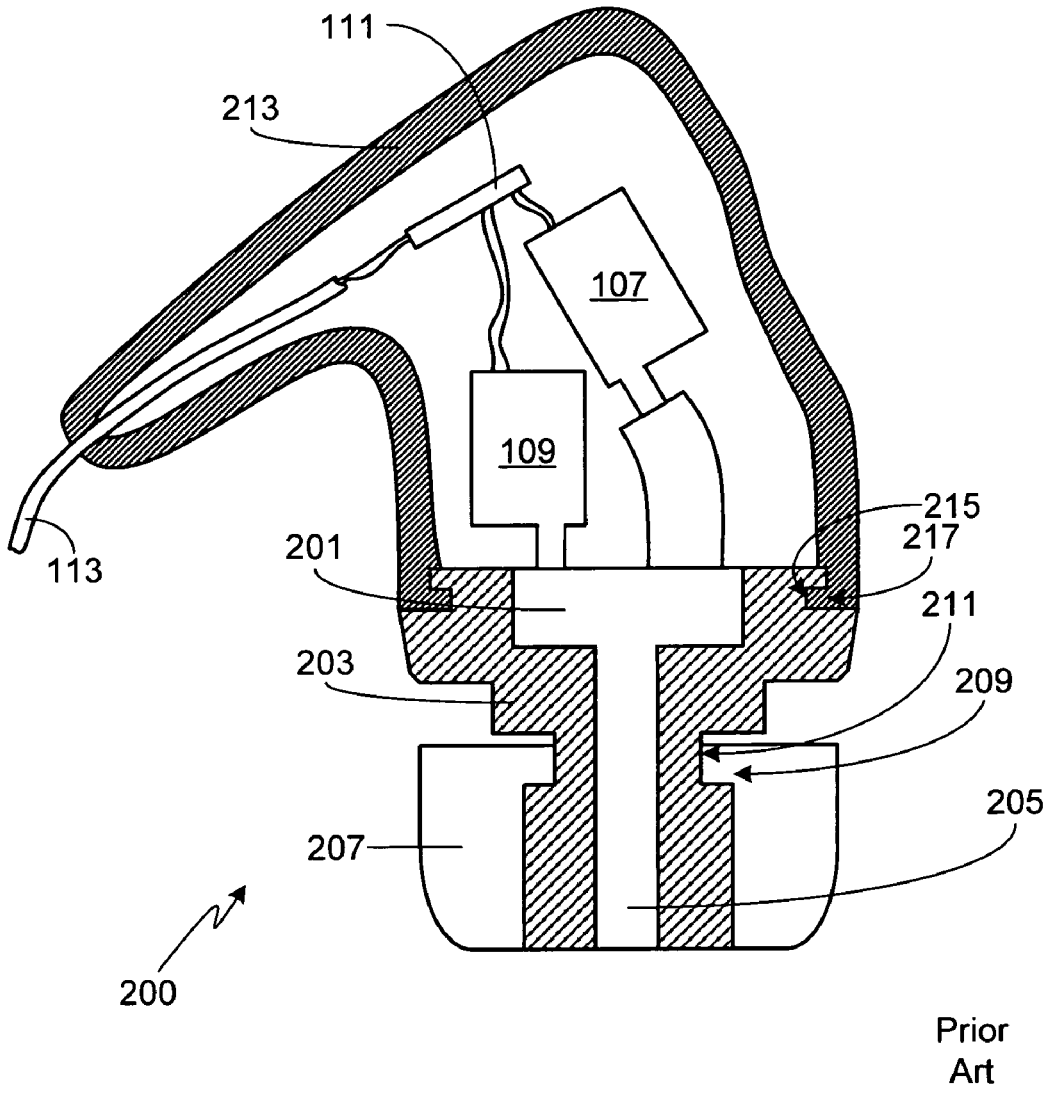
FIG. 2 is a cross-sectional view of a generic earpiece according to the prior art.

FIG. 2 is a cross-sectional view of a generic earpiece 200 in accordance with the prior art. As in the prior example, monitor 200 includes a pair of drivers 107/109, a crossover circuit 111 and a coupling cable 113. The output from each driver enters an acoustic mixing chamber 201 within sound delivery member 203. A single sound delivery tube 205 delivers the mixed audio from the two drivers through the sound delivery member 203 to the user. Sound delivery member 203 is designed to fit within the outer ear canal of the user and as such, is generally cylindrical in shape.

Attached to the end portion of sound delivery member 203 is an eartip 207, also referred to as an eartip sleeve or simply a sleeve. Eartip 207 can be fabricated from any of a variety of materials including foam, plastic and silicon-based material. Sleeve 207 can have the generally cylindrical and smooth shape shown in FIG. 2, or can include one or more flanges. To hold sleeve 207 onto member 203 during normal use but still allow the sleeve to be replaced when desired, typically the eartip includes a lip portion 209 which is fit into a corresponding channel or groove 211 in sound delivery member 203. The combination of an interlocking groove 211 with a lip 209 provides a convenient means of replacing eartip 207, allowing sleeves of various sizes, colors, materials, material characteristics (density, compressibility), or shape to be easily attached to in-ear monitor 200. As a result, it is easy to provide the end user with a comfortable fit at a fraction of the cost of a custom fit earpiece. Additionally, the use of interlocking members 209 and 211 allow worn out eartips to be quickly and easily replaced. It will be appreciated that other eartip mounting methods can be used with earpiece 200. For example, eartip 207 can be attached to sound delivery member 203 using pressure fittings, bonding, etc.

An outer earpiece enclosure 213 attaches to sound delivery member 203. Earpiece enclosure 213 protects drivers 107/109 and any required earpiece circuitry (e.g., crossover circuit 111) from damage while providing a convenient means of securing cable 113 to the in-ear monitor. Enclosure 213 can be attached to member 203 using interlocking members (e.g., groove 215, lip 217). Alternately, an adhesive or other means can be used to attach enclosure 213 to member 203. Enclosure 213 can be fabricated from any of a variety of materials, thus allowing the designer and/or user to select the material's firmness (i.e., hard to soft), texture, color, etc. Enclosure 213 can either be custom molded or designed with a generic shape.

In the generic prior art earpiece shown in FIG. 2, the primary constraint placed on the size and/or number of sound delivery tubes is the inner diameter of the smallest region of the sound delivery member, i.e., the ID of grooved region 211 of member 203. A typical ID for this region is 4.8 millimeters. Co-pending U.S. patent application Ser. No. 11/051,865 overcomes this design limitation with a design that permits multiple sound delivery tubes to pass through the restrictive region of the sound delivery member of a generic earpiece.

Figure 3:
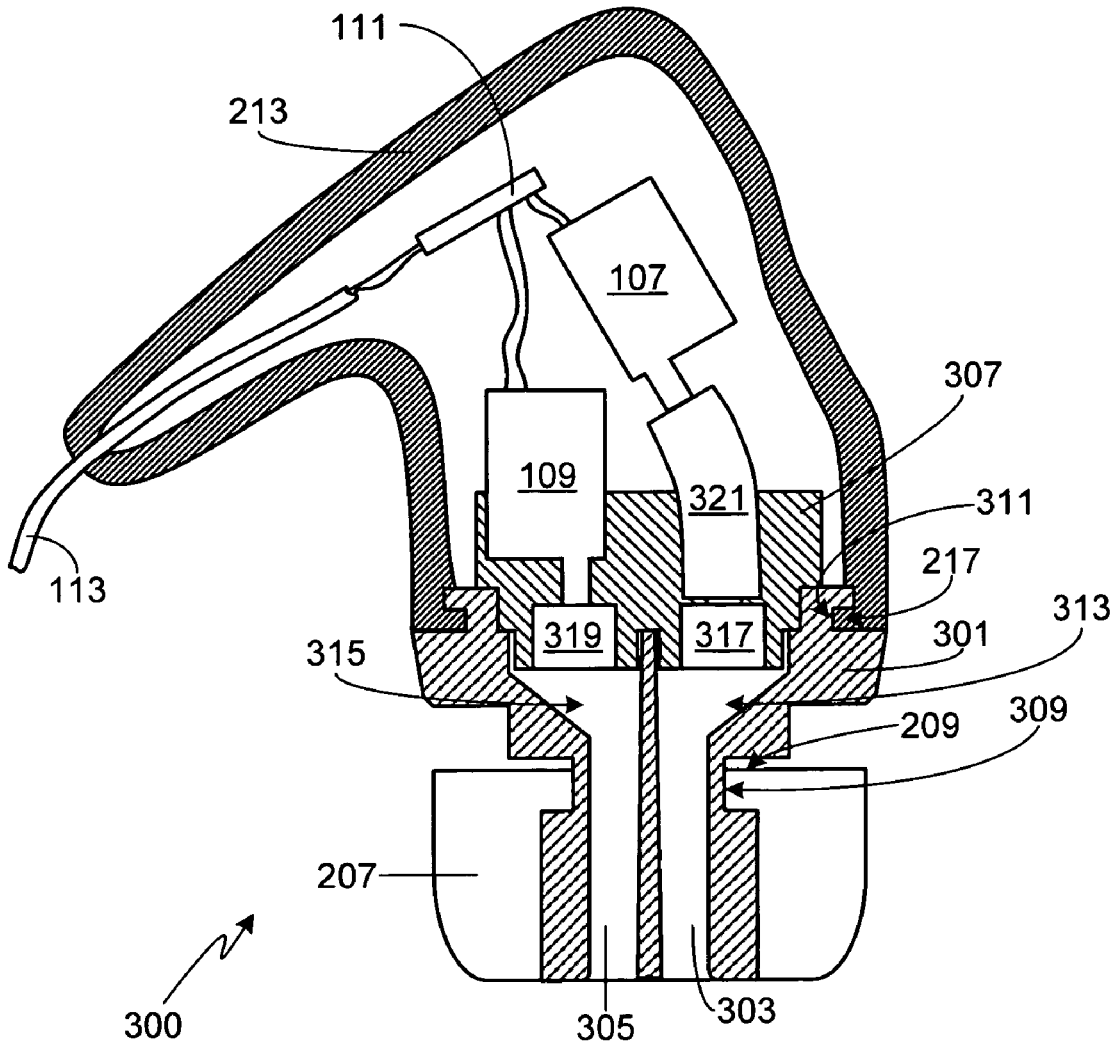
FIG. 3 is a cross-sectional view of a generic earpiece that includes a pair of sound delivery tubes and a predetermined driver offset.
Figure 4:
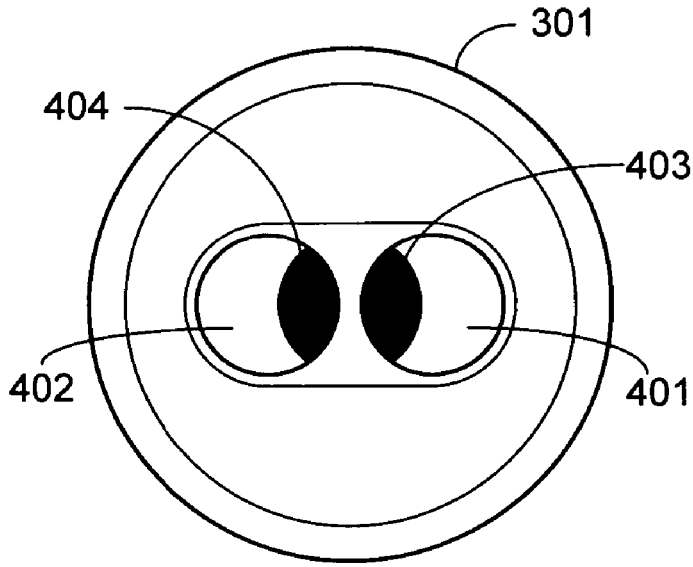
FIG. 4 is a view of the input surface of the sound delivery member of FIG. 3.
Figure 5:
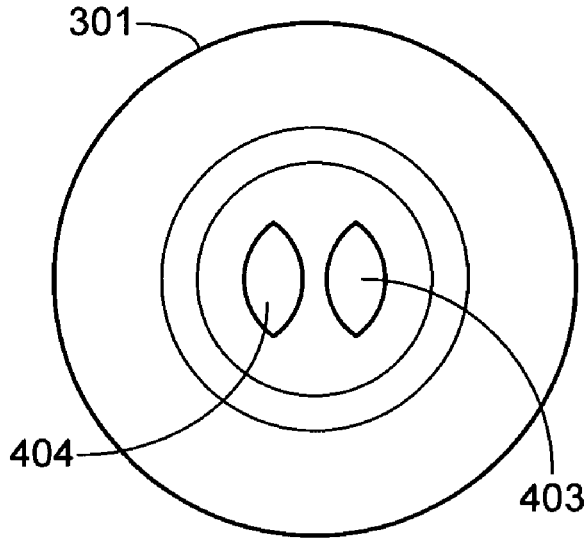
FIG. 5 is a view of the output surface of the sound delivery member shown in FIG. 4.

As shown in FIGS. 3-5, in addition to the previously described components, sound delivery member 301 of earpiece 300 includes two separate sound delivery tubes 303/305, corresponding to drivers 107 and 109, respectively. Preferably sound delivery member 301 is molded, thus permitting sound delivery tubes 303/305 to be easily fabricated within the member. Also preferably a boot member 307 attaches to sound delivery member 301, boot member 307 securing the components to the sound delivery member while still providing a means of including acoustic filters as described more fully below. As with the embodiment illustrated in FIG. 2, monitor 300 includes a removable sleeve 207 (e.g., foam sleeve, silicon sleeve, flanged sleeve, etc.) which is attached by interlocking sleeve lip 209 onto groove 309 of member 301. Similarly, monitor 300 includes a housing enclosure 213 coupled to member 301 using interlocking members (e.g., groove 311, lip 217)

In the embodiment illustrated in FIGS. 3-5, sound delivery tubes 303/305 include transition regions 313/315, respectively. Regions 313/315 redirect the sound emitted by the drivers to the two delivery tubes 303/305, thus insuring that the tubes pass through the small ID of member 301, in particular the necked down region 309 of member 301. Although not required, in at least one embodiment an acoustic damper is interposed between each driver and its corresponding sound delivery tube. Specifically, damper 317 is interposed between driver 107 and sound tube 303 while damper 319 is interposed between driver 109 and sound tube 305. Alternately a single damper can be used, corresponding to either driver 107 or driver 109. The use of dampers allows the output from the in-ear monitor 300 in general, and the output from either driver in particular, to be tailored. Tailoring may be used, for example, to reduce the sound pressure level overall or to reduce the levels for a particular frequency range or from a particular driver.

FIGS. 4 and 5 illustrate angled transition regions 313 and 315. More specifically, FIG. 4 is a view of the input surface of sound delivery member 301. This view shows the input ports 401 and 402 for sound delivery tubes 303 and 305, respectively. Shaded regions 403 and 404 indicate the exit ports for sound delivery tubes 303 and 305, respectively. FIG. 5 is a view of the output surface of sound delivery member 301 and as such, provides another view of sound delivery tube exit ports 403 and 404.

In a preferred embodiment of the invention utilizing transition regions, sound delivery tubes 303 and 305 are compressed, and somewhat flattened, yielding the final double tear-drop shape shown in FIGS. 4 and 5. It will be appreciated that this shape, although preferred, is not required. For example, back-to-back "D" shaped ports would provide sound throughput while still providing sufficient compression to pass through member 301.

The inventors have found that although the use of individual sound delivery tubes for each driver greatly improves the sound quality of a generic earpiece, further improvements can be made by tuning the design. In part, tuning can be accomplished using one or more dampers as described above (e.g., dampers 317/319), each damper tailoring the frequency response of the corresponding driver over a specific range of frequencies. Additionally the inventors have found that further tuning can be accomplished through the proper choice of the length of each sound delivery tube and, to a lesser degree, the separation distance between the sound delivery tubes at the exit plane of the earpiece.

As previously noted, since a single driver is unable to accurately reproduce audio over the desired frequency range (i.e., the range of human hearing), preferably an earpiece will employ two or more drivers with each driver optimized for a specific frequency range (i.e., low and high or low, medium, and high). Due to size constraints as well as the limitations of each driver type, typically such an earpiece will utilize all armatures or a combination of one or more armatures with a diaphragm driver.

In designing an earpiece that utilizes multiple drivers, the frequency response for each of the individual drivers and the phase shift introduced by the filter (e.g., crossover circuit) are two of the most influential factors in determining the quality of the sound delivered by the earpiece. In a typical earpiece, however, packaging constraints typically determine the locations of the individual drivers, especially if the earpiece utilizes multiple drivers. Accordingly, the designer of a conventional earpiece relies on filtering to achieve the desired audio performance, the filters being in the form of circuits (e.g., crossover filters) and physical dampers (e.g., dampers 317/319 of FIG. 3).

The present inventors have found that further audio improvements can be achieved by utilizing a multiple sound delivery tube arrangement (e.g., FIGS. 3-5) in which the lengths of the tubes, and to a lesser degree the relative positions of the output ends of the sound delivery tubes, are appropriately selected.

When the driver outputs are displaced relative to one another, a time delay is introduced between the frequency ranges produced by each of the drivers. Thus if three drivers are used (i.e., low, mid and high frequencies), a time delay and thus a phase shift is introduced between each of these frequency ranges, the amount of delay being dependent upon the relative locations of the drivers within the earpiece.

Although the relative locations of the drivers within the exit plane of the eartip can introduce a time delay, the amount of time delay is typically quite small given the close proximity of the individual driver outputs. Additionally the ability of the earpiece designer to adjust this delay is minimal given the diameter of the sound delivery tubes and the physical constraints of the sound delivery member (e.g., member 301 of FIG. 3). Of much greater importance is the time delay that can be introduced by offsetting the drivers using varying lengths for the sound delivery tubes.

In determining the appropriate time delay to introduce into an earpiece design, the first step is to determine the phase shift inherent in a specific earpiece design, the inherent phase shift introduced by the frequency dividing network, driver roll-off rates, driver bandwidth and exit plane sound tube displacement. This phase shift can then be corrected through the selection of an appropriate driver offset.

As an example of the invention as applied to a two driver earpiece, assume that the phase shift inherent in the specific earpiece design is 45 degrees (equivalent to ⅛ of a wavelength). To compensate for this phase shift, and assuming that the center of the frequency range of interest is 11.5 kHz (equivalent to a wavelength of 30 mm), a driver offset of 3.75 mm is required (i.e., ⅛*30=3.75). Accordingly, assuming an earpiece design such as that illustrated in FIG. 3, sound delivery tube 321 is used to achieve the desired driver offset and minimize the phase shift based cancellation of high frequencies (e.g., frequencies above 7 kHz). Although offsetting the drivers as described above improves earpiece performance, further improvement can be achieved using a repetitive process in which the calculated offset is only the starting point. Although the repetitive process can be performed for a preset number of iterations, preferably after making the initial driver offset further phase shift measurements along with minor driver offset adjustments are continued until only minimal phase shift based cancellation of high frequencies is observed. In an alternate embodiment, after making the initial driver offset as described above, additional audio performance optimization is performed based on the measured frequency response of the earpiece rather than basing the additional audio performance optimization on the earpiece's phase response. If additional optimization is performed via an iterative approach, preferably the driver offset is varied by less than ±10% of the calculated offset (i.e., ±0.375 mm in the above example).

As previously noted, the driver offsetting system of the present invention is not limited to two driver earpieces. It should be noted, however, that time domain misalignment is normally not an issue in the lower frequencies and therefore in a three (or more) driver earpiece, typically only the phase shift between the high frequency driver and the mid-frequency driver is corrected via driver offsetting. Furthermore, the inventors have found that it is preferable to keep the high frequency driver as close as possible to the eartip, thus requiring driver offsetting to be performed on the lower frequency driver (or mid-frequency driver in a three-driver earpiece). The reason for this preference is that the lower frequencies are less susceptible to separation induced audio degradation (i.e., separation between the driver and the eartip).

Although an earpiece in accordance with the invention can use transition regions between the drivers and the end portion of the sound delivery tube (e.g., transition regions 313/315), it will be appreciated that such transition regions are not a requirement of the invention. For example, in embodiment 600 illustrated in FIG. 6, the sound delivery tubes maintain the same inside diameter throughout the entire earpiece. As shown, high frequency driver 109, preferably captured within a boot member 601, is coupled directly to sound delivery tube 603 while the output from low frequency driver 107 is coupled to a two-piece sound delivery tube 605/607. The first portion 605 of the sound delivery tube coupled to driver 107 provides the required flexibility to adjust the length of the sound delivery tube in accordance with the invention, i.e., as a means of tuning the earpiece while the second portion 607 of this sound tube is formed within sound delivery member 609. Although the illustrated embodiment only shows a single tuning sound delivery tube section (i.e., section 605 coupled to driver 107), both drivers can be fitted with sound delivery tube extensions, thus providing additional flexibility in adjusting the driver offset in accordance with the invention.

It will be appreciated that although the sound delivery tubes integrated within the sound delivery member are relatively rigid, additional sound delivery tubes that are coupled to the integral sound delivery tubes can be shaped, thus providing the earpiece designer flexibility in achieving both the desired driver offset and earpiece packing efficiency. For example as shown in FIG. 7, sound delivery tube offsetting extension 701 has a slight curvature, thus allowing for a smaller earpiece enclosure 703 then that of the previous embodiment.

Figure 8:
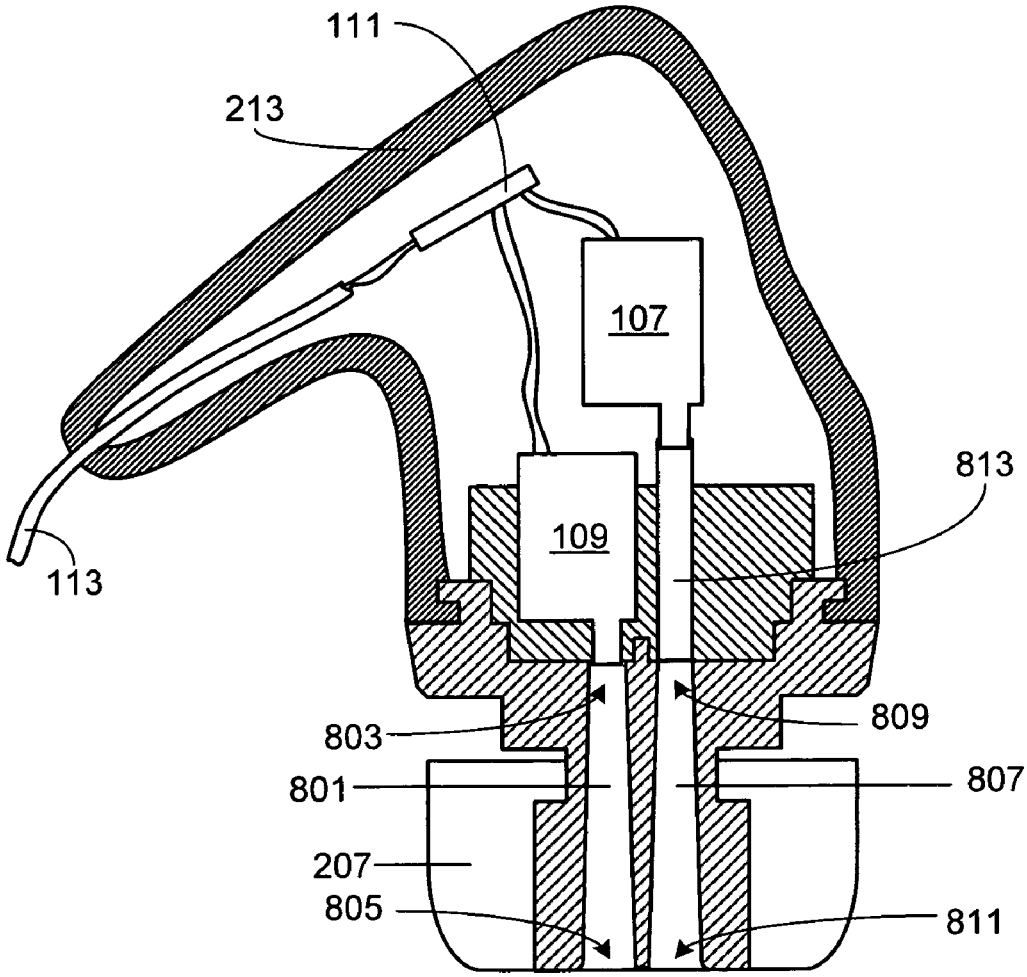
FIG. 8 is a cross-sectional view of a generic earpiece utilizing sound delivery tubes that transition from a smaller diameter to a larger diameter, the larger diameter region located at the acoustic output portion of each tube.

In an alternate preferred embodiment illustrated in FIG. 8, the sound delivery tubes transition from a first diameter, for example at the tube entrance, to a second diameter, for example at the tube output, thus transitioning in the opposite direction from that shown in FIGS. 3-5. As shown, sound delivery tube 801 transitions from the diameter at tube input 803, to the larger diameter at tube output 805. Similarly, sound delivery tube 807 transitions from the diameter at tube input 809, to the larger diameter at tube output 811. In this embodiment portion 813 of the sound delivery tube coupled to driver 107 has a uniform inner diameter.

Figure 6:
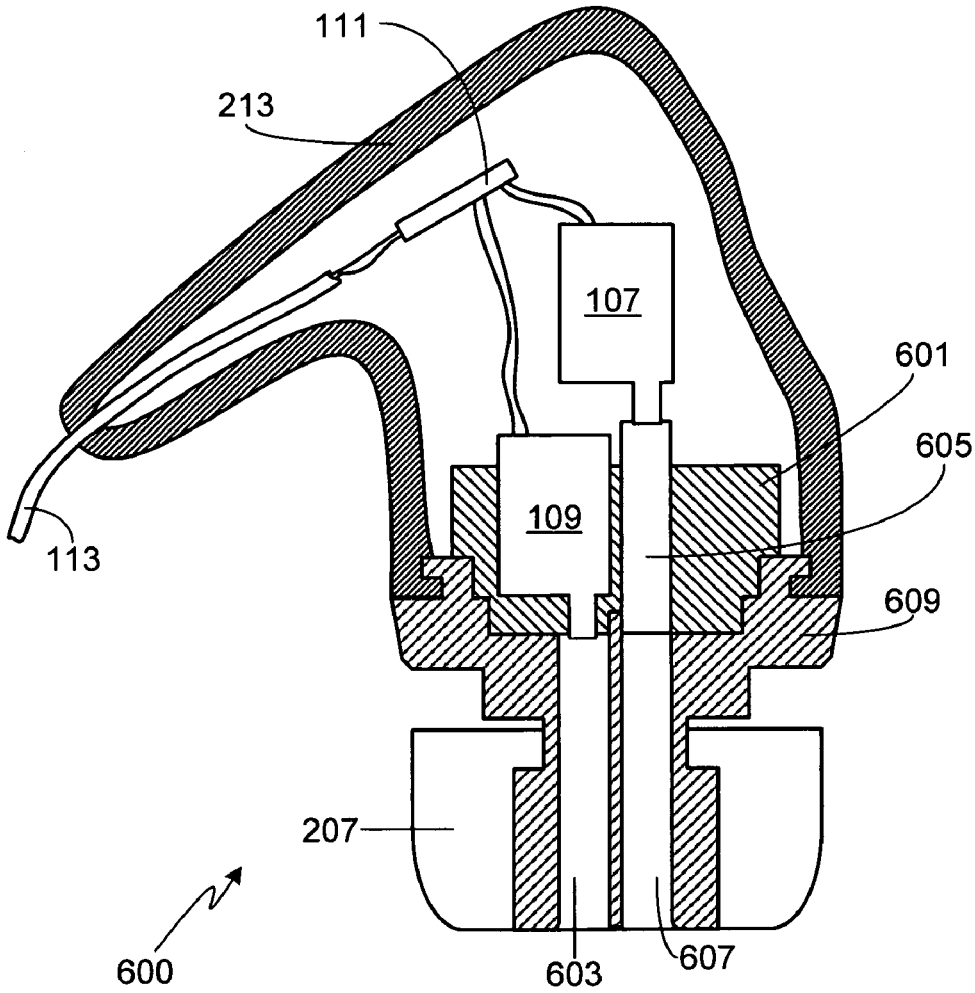
FIG. 6 is a cross-sectional view of a generic earpiece in which the sound delivery tubes have a uniform diameter maintained throughout their length.
Figure 7:
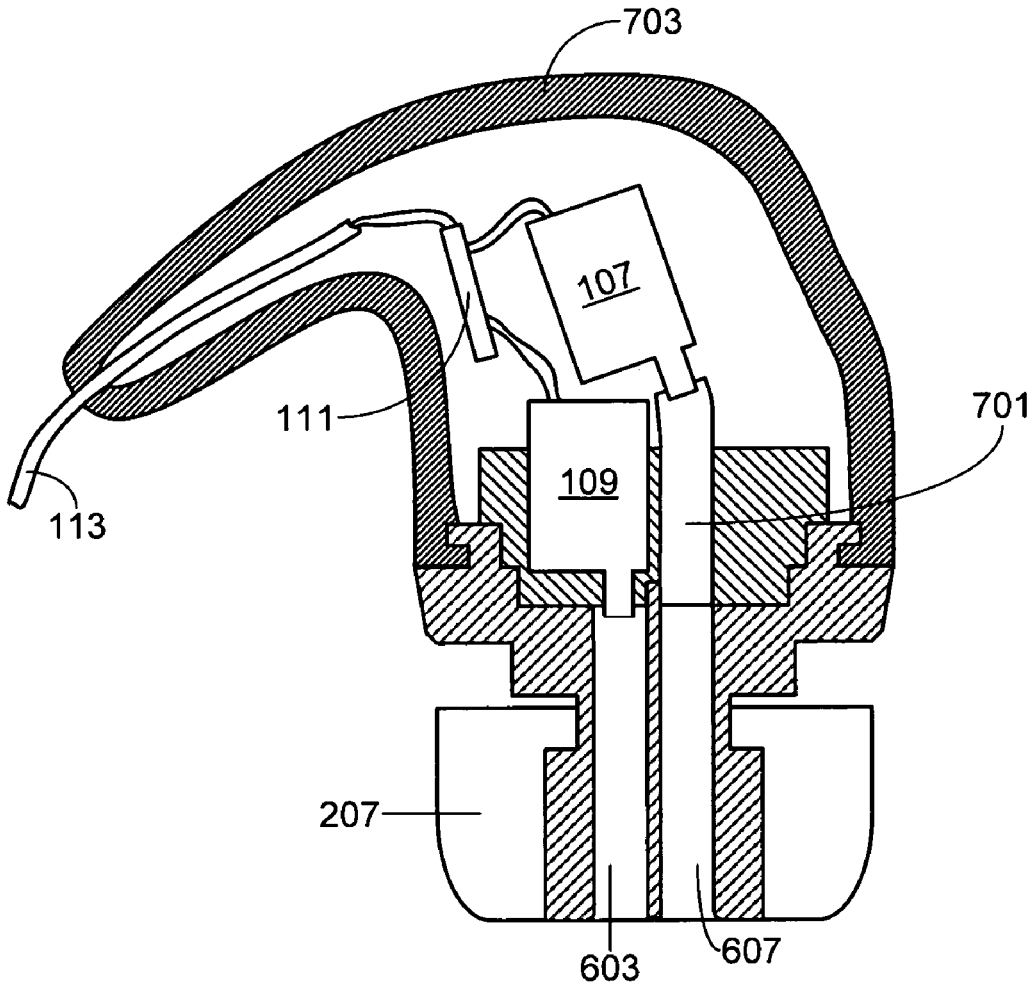
FIG. 7 is a cross-sectional view of a generic earpiece similar to that shown in FIG. 6, except for the use of a curved sound delivery tube.
Figure 9:
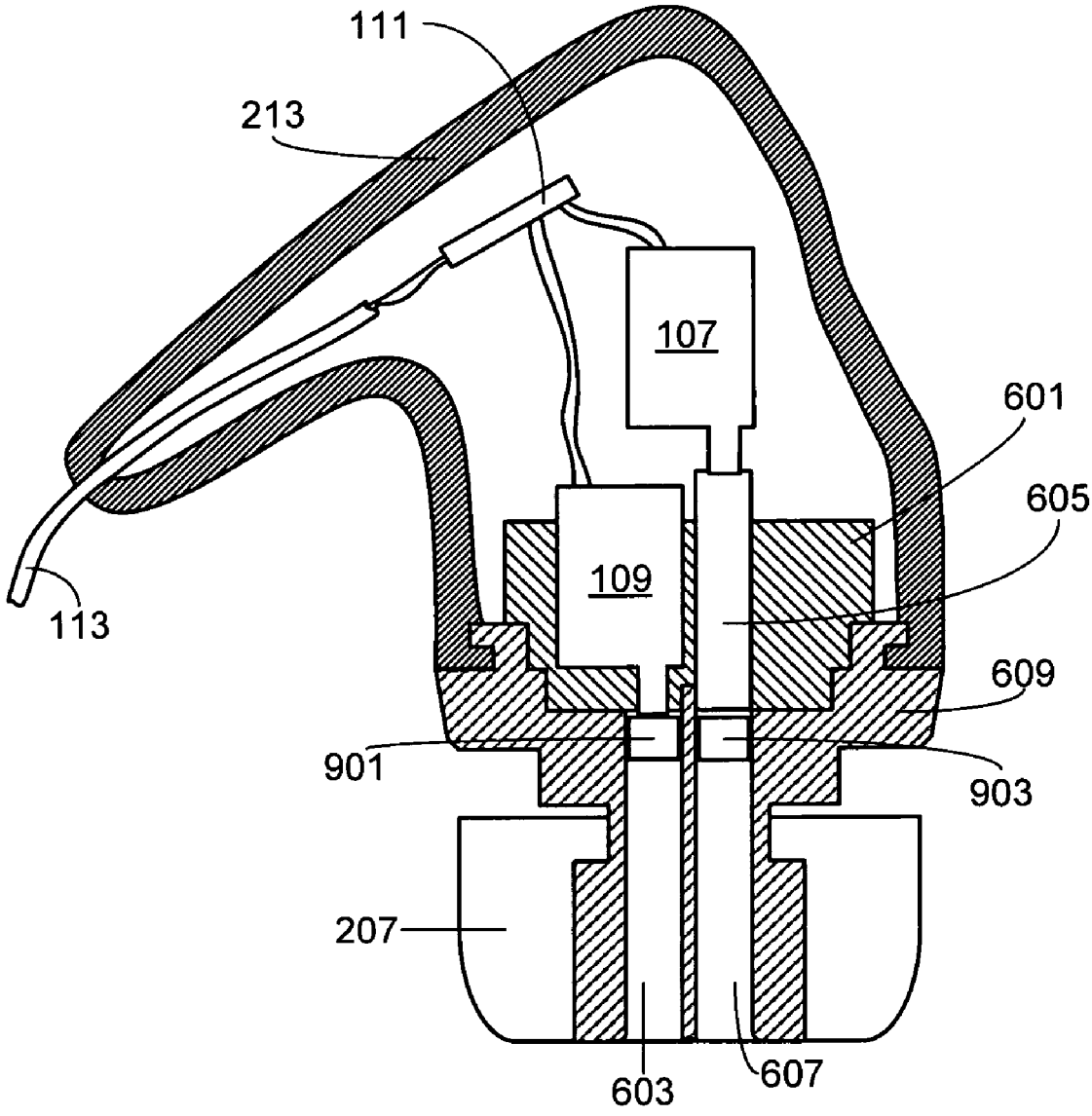
FIG. 9 is a cross-sectional view of a generic earpiece similar to that shown in FIG. 6, except for the inclusion of dampers.

It should be understood that any of the embodiments illustrated in FIGS. 6-8 can utilize dampers, such as those described relative to earpiece 300, in one or more of the sound tubes. For example, embodiment 900 shown in FIG. 9 is the same as embodiment 600 except for the inclusion of sound dampers 901 and 903 in sound delivery tubes 603 and 607, respectively.

Figure 10:
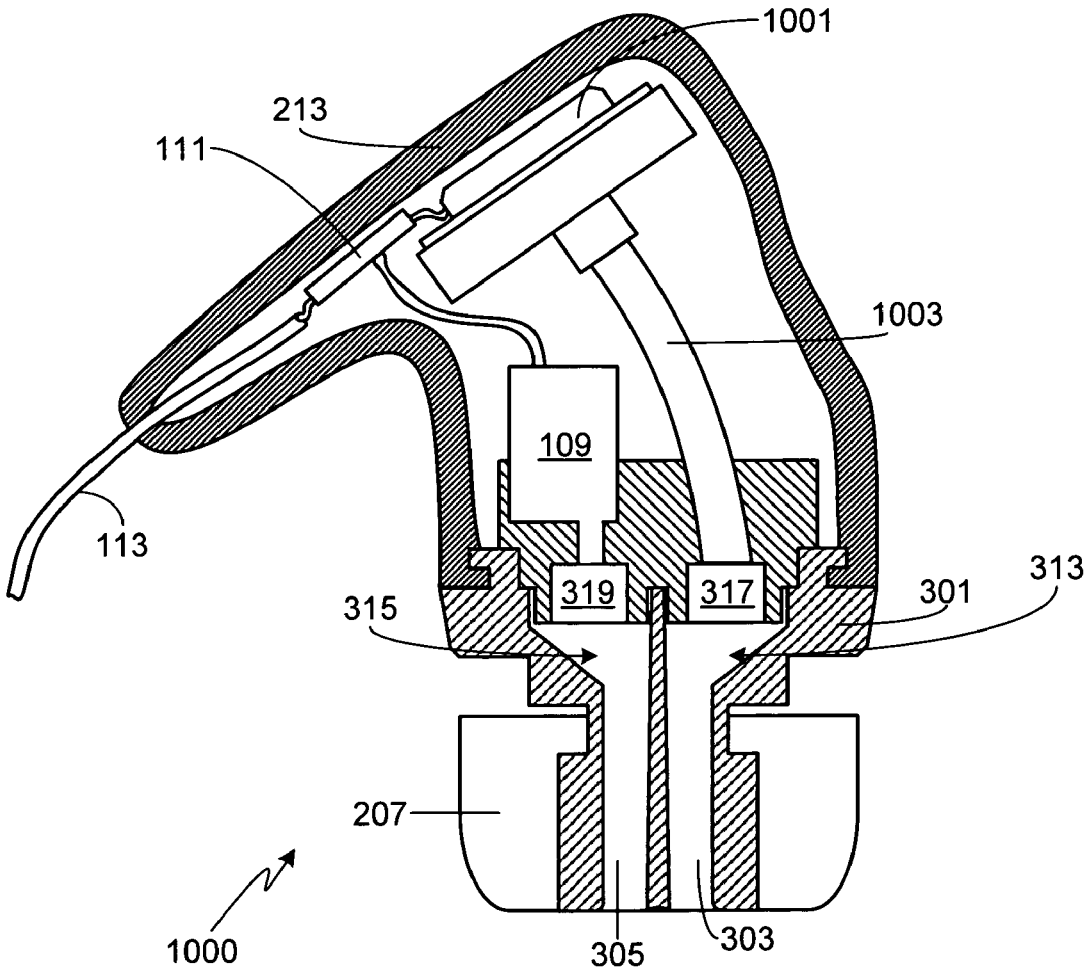
FIG. 10 is a cross-sectional view of a generic earpiece that includes a pair of sound delivery tubes, both armature and diaphragm-based drivers, and a predetermined driver offset.
Figure 11:
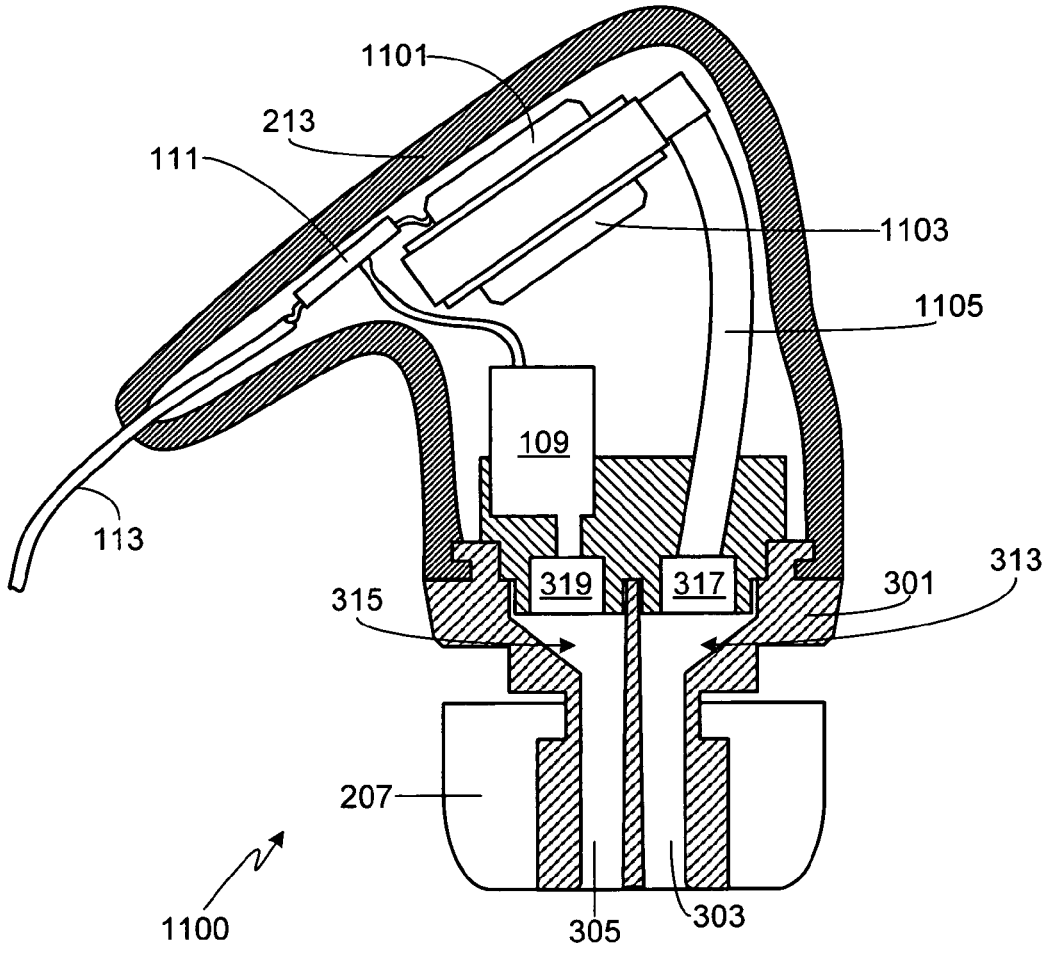
FIG. 11 is a cross-sectional view of a generic earpiece that includes a pair of sound delivery tubes, one coupled to an armature driver and the other coupled to a pair of diaphragm-based drivers.

As previously noted, the present invention can utilize either, or both, armature drivers and diaphragm drivers. The primary constraints placed on the invention are that the drivers are coupled to the eartip via individual sound delivery tubes. Furthermore in preferred embodiments of the invention, the sound delivery member is configured to accept replaceable eartip sleeves. Alternate exemplary embodiments of the invention are shown in FIGS. 10 and 11. In earpiece 1000, after determining the inherent phase shift of the earpiece, low frequency diaphragm driver 1001 is offset by the calculated amount, the offset introduced via sound tube 1003. In earpiece 1100, after determining the inherent phase shift of the earpiece, the pair of diaphragm drivers 1101/1103 are offset using single sound delivery tube 1105.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An earpiece, comprising:

a sound delivery member, wherein an end portion of said sound delivery member is configured to accept a removable eartip;

an enclosure coupled to said sound delivery member;

means for receiving a signal from an external source;

a first driver disposed within said enclosure and electrically coupled to said receiving means, said first driver having a first acoustic output;

a first sound delivery tube of a first length interposed between said first driver and said end portion of said sound delivery member, wherein at least a portion of said first sound delivery tube is integrated within said sound delivery member, wherein said first acoustic output is acoustically coupled to an acoustic input of said first sound delivery tube, and wherein an acoustic output of said first sound delivery tube is acoustically coupled to said end portion of said sound delivery member;

a second driver disposed within said enclosure and electrically coupled to said receiving means, said second driver having a second acoustic output;

a second sound delivery tube of a second length interposed between said second driver and said end portion of said sound delivery member, wherein at least a portion of said second sound delivery tube is integrated within said sound delivery member, wherein said first and second sound delivery tubes are discrete, wherein said second acoustic output is acoustically coupled to an acoustic input of said second sound delivery tube, and wherein an acoustic output of said second sound delivery tube is acoustically coupled to said end portion of said sound delivery member; and means for compensating for a phase shift between said first and second drivers, wherein said phase shift is specific to at least one predetermined frequency, and wherein said compensating means further comprises setting at least one of said first and second lengths of said first and second sound delivery tubes to a phase shift compensating length.

2. The earpiece of claim 1, wherein said first sound delivery tube further comprises a first transition region and said second sound delivery tube further comprises a second transition region, wherein a first center-to-center spacing between said first and second delivery tubes prior to said first and second transition regions is greater than a second center-to-center spacing between said first and second after said first and second transition regions.

3. The earpiece of claim 1, wherein said first sound delivery tube further comprises a first transition region for transitioning from a first inside diameter to a second inside diameter.

4. The earpiece of claim 3, wherein said first inside diameter is proximate to said acoustic input of said first sound delivery tube and wherein said first inside diameter is larger than said second inside diameter.

5. The earpiece of claim 3, wherein said first inside diameter is proximate to said acoustic output of said first sound delivery tube and wherein said first inside diameter is larger than said second inside diameter.

6. The earpiece of claim 3, wherein said second sound delivery tube further comprises a second transition region for transitioning from a third inside diameter to a fourth inside diameter.

7. The earpiece of claim 6, wherein said third inside diameter is proximate to said acoustic input of said second sound delivery tube and wherein said third inside diameter is larger than said fourth inside diameter.

8. The earpiece of claim 6, wherein said third inside diameter is proximate to said acoustic output of said second sound delivery tube and wherein said third inside diameter is larger than said fourth inside diameter.

9. The earpiece of claim 1, wherein said acoustic output of said first sound delivery tube and said acoustic output of said second sound delivery tube each have a double tear-drop shape.

10. The earpiece of claim 1, said receiving means further comprising a cable coupleable to said external source.

11. The earpiece of claim 1, said receiving means further comprising a passive crossover circuit, said passive crossover circuit supplying a first electrical signal to said first driver and a second electrical signal to said second driver.

12. The earpiece of claim 1, said receiving means further comprising an active crossover circuit, said active crossover circuit supplying a first electrical signal to said first driver and a second electrical signal to said second driver.

13. The earpiece of claim 1, further comprising an acoustic damper interposed between said first acoustic output and said first sound delivery tube.

14. The earpiece of claim 13, further comprising a second acoustic damper interposed between said second acoustic output and said second sound delivery tube.

15. The earpiece of claim 1, further comprising an acoustic damper, wherein said first sound delivery tube is comprised of at least a first section and a second section, and wherein said acoustic damper is interposed between said first section and said second section.

16. The earpiece of claim 15, further comprising a second acoustic damper, wherein said second sound delivery tube is comprised of at least a first section and a second section, and wherein said second acoustic damper is interposed between said first section and said second section of said second sound delivery tube.

17. The earpiece of claim 1, further comprising a boot member coupled to said sound delivery member.

18. The earpiece of claim 1, wherein said first driver comprises a first armature driver and said second driver comprises a second armature driver.

19. The earpiece of claim 1, wherein said first driver comprises an armature driver and said second driver comprises a diaphragm driver.

20. The earpiece of claim 1, wherein said first driver comprises an armature driver and said second driver comprises a pair of diaphragm drivers.

21. A method of compensating for a phase shift within an earpiece, the method comprising the steps of:

assembling the earpiece, said assembling step comprising the steps of:

coupling at least a first driver and a second driver to a crossover network;

coupling an acoustic output of said first driver to a first sound delivery tube; and coupling an acoustic output of said second driver to a second sound delivery tube, wherein said second sound delivery tube is discrete from said first sound delivery tube;

measuring the phase shift for said earpiece;

calculating a driver offset required to cancel the phase shift; and offsetting said first driver relative to said second driver by the calculated driver offset.

22. The method of claim 21, wherein said calculating step is performed for a specific frequency.

23. The method of claim 21, further comprising the steps of:

re-measuring the phase shift for the earpiece; and adjusting the driver offset to further reduce phase shift based frequency cancellation.

24. The method of claim 23, wherein said steps of re-measuring the phase shift and adjusting the driver offset are repeated for a predetermined number of times.

25. The method of claim 23, wherein said steps of re-measuring the phase shift and adjusting the driver offset are continued until phase shift based frequency cancellation at frequencies greater than 7 kHz is minimized.

26. The method of claim 21, further comprising the steps of:

measuring a frequency response for the earpiece after completing the offsetting step; and adjusting the driver offset to further flatten the frequency response for the earpiece.

27. The method of claim 26, wherein said steps of measuring the frequency response and adjusting the driver offset are repeated for a predetermined number of times.

28. The method of claim 26, wherein said steps of measuring the frequency response and adjusting the driver offset are repeated until optimal frequency response is achieved.

* * * * *